US007758918B2

(12) United States Patent
Postoaca

(10) Patent No.: US 7,758,918 B2
(45) Date of Patent: Jul. 20, 2010

(54) METHOD AND DEVICE FOR PROVIDING A SUBSTRATE WITH A COATING LAYER OF A POLYMERIC MATERIAL

(75) Inventor: Ion Postoaca, Bjärred (SE)

(73) Assignee: Tetra Laval Holdings & Finance S. A., Pully (CH)

( * ) Notice: Subject to any disclaimer, the term of this patent is extended or adjusted under 35 U.S.C. 154(b) by 0 days.

(21) Appl. No.: 10/583,960

(22) PCT Filed: Nov. 19, 2004

(86) PCT No.: PCT/SE2004/001695

§ 371 (c)(1),
(2), (4) Date: Apr. 30, 2007

(87) PCT Pub. No.: WO2005/061124

PCT Pub. Date: Jul. 7, 2005

(65) Prior Publication Data

US 2007/0275165 A1 Nov. 29, 2007

(30) Foreign Application Priority Data

Dec. 23, 2003 (SE) ..... 0303529

(51) Int. Cl.
*B05D 1/12* (2006.01)
*B05B 7/16* (2006.01)

(52) U.S. Cl. ..... 427/193; 427/422; 427/427.4; 118/302; 118/308

(58) Field of Classification Search ..... 427/193, 427/422, 427.4; 118/302
See application file for complete search history.

(56) References Cited

U.S. PATENT DOCUMENTS

| | | | | |
|---|---|---|---|---|
| 3,958,758 | A * | 5/1976 | Piorkowski | 239/133 |
| 4,289,807 | A * | 9/1981 | Christensen et al. | 427/195 |
| 5,021,259 | A * | 6/1991 | Singelyn | 427/115 |
| 5,211,990 | A * | 5/1993 | McKinney et al. | 427/447 |
| 5,233,153 | A * | 8/1993 | Coats | 219/121.47 |
| 5,503,872 | A * | 4/1996 | MacKenzie et al. | 427/195 |
| 2003/0215644 | A1 * | 11/2003 | Deshpande et al. | 428/416 |

FOREIGN PATENT DOCUMENTS

| | | | |
|---|---|---|---|
| EP | 0 316 571 | A2 | 5/1989 |
| EP | 0 437 721 | A1 | 7/1991 |
| GB | 1 226 409 | A | 3/1971 |
| WO | WO 97/36049 | A1 | 10/1997 |

* cited by examiner

*Primary Examiner*—Frederick J Parker
(74) *Attorney, Agent, or Firm*—Buchanan Ingersoll & Rooney PC

(57) ABSTRACT

A method and device for providing a substrate (10) with a coating layer (13) of a polymeric material, comprising the steps: a) a pulverous, polymeric material (2) is suspended (1) in a fluid (3), b) the fluid (3) is pressurised (5), c) the pressurised suspension is ejected (16) onto the substrate (10) to form the coating layer (13), d) the polymeric material is, during any one of steps a)-c), heated (4, 6, 11) to a temperature above its softening temperature.

26 Claims, 1 Drawing Sheet

Figure 1:
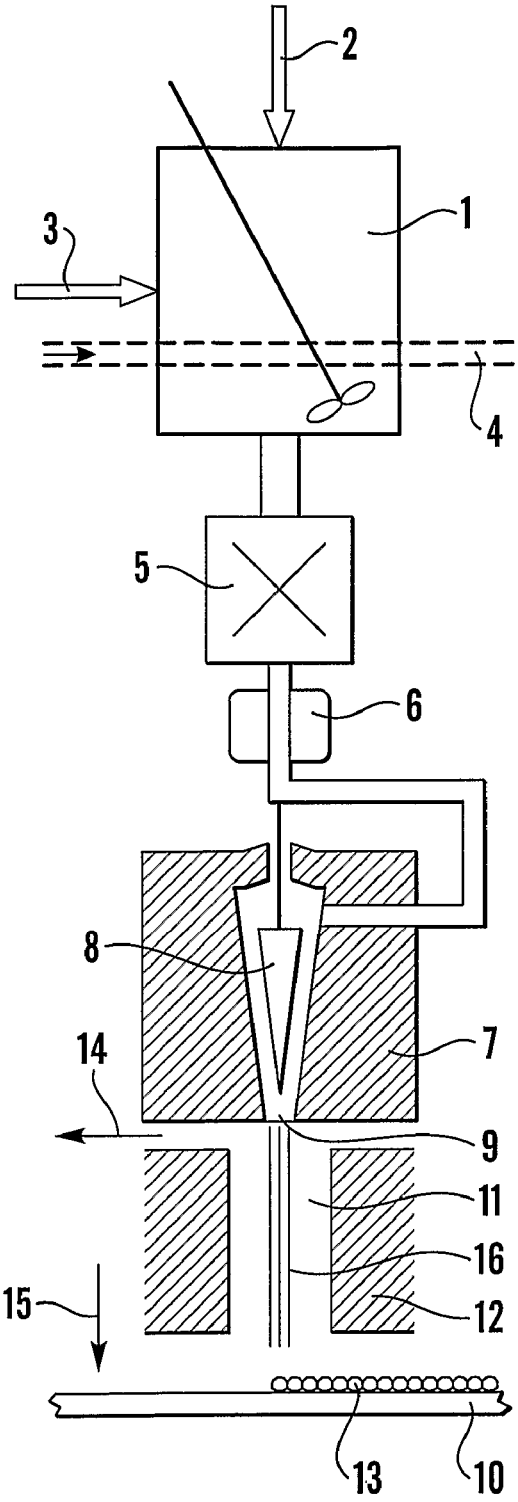

METHOD AND DEVICE FOR PROVIDING A SUBSTRATE WITH A COATING LAYER OF A POLYMERIC MATERIAL

TECHNICAL FIELD

The present invention relates to a method and a device for providing a substrate with a coating layer of a polymeric material. The invention has especially been developed for, but is not limited to, the coating of a packaging laminate with a polymer layer.

PRIOR ART

The coating of a web-shaped substrate, such as a packaging laminate, with a layer of polymeric material, is performed commercially by extrusion of a polymer layer onto the substrate or by coating the substrate with a dispersion or solution of a polymeric material. The polymer layer may have the function of a barrier layer, against penetration of gas or liquid, a sealing layer etc.

Even though the today known methods of extrusion and coating are functioning well, there are drawbacks of such techniques. Of all known drawbacks, only a few will be mentioned in the following. By such techniques, it is e.g. difficult to coat parts of the surface of the substrate or to coat non-uniform surfaces or surfaces in different planes. Furthermore, the known techniques require that the polymeric material that during its manufacturing has taken a pulverous form, is processed by e.g. granulation, which means that the original properties of the polymer are affected, often in a negative way. By the known techniques, it is also difficult to be able to apply a very thin coating layer.

BRIEF SUMMARY OF THE INVENTION

The present invention aims at providing an alternative technique of coating a substrate with a coating layer of a polymeric material. The invention also aims at providing such an alternative technique by which the above mentioned drawbacks of known techniques are overcome or at least diminished. The invention aims primarily at providing such a technique for coating a substrate for a packaging laminate, especially for packaging of liquid foods, with a polymeric material.

These and other objectives are achieved by the invention as defined in the claims.

Hence, the method according to the invention relates to a method of providing a substrate with a coating layer of a polymeric material, comprising the steps that:

a) a pulverous, polymeric material is suspended in a fluid,
b) the fluid is pressurised,
c) the pressurised suspension is ejected onto the substrate to form the coating layer,
d) the polymeric material is, during any one of steps a-c, heated to a temperature above its softening temperature.

The invention is based on the idea that a coating layer of a polymeric material on a substrate can be achieved from a pulverous polymeric material that is being heated to a temperature above its softening temperature, but preferably below its melting temperature, and thereafter is brought by great force to hit the substrate. Together, the softened surface of the pulverous particles and the great force of impact result in a "sintering-like" coating of the substrate.

One advantage of the method according to the invention, is that the used pulverous particles of polymeric material may be the pulverous particles as formed directly in connection with the manufacturing of the polymeric material, i.e. the pulverous form that the polymeric material has taken during its manufacturing in a reactor. Usually, the pulverous, polymeric material has a mean particle size of 1-100 μm, preferably 1-50 μm, and even more preferred 1-25 μm. If it is only the surface of the pulverous particles that is softened, the original properties of the polymeric material will largely be intact in the formed coating layer, which is a major advantage.

Another advantage of the method according to the invention, is that it is easily controlled to enable forming of very thin coating layers, such as layers having a thickness of 0.1-5 μm, preferably 0.1-2 μm, and even more preferred 0.1-1 μm. Moreover, the method allows for forming such coating layers also on substrates that are non-uniform or are arranged in different planes, thanks to the method advantageously being contactless in relation to the substrate. Furthermore, the method allows for essentially the entire surface of one side of the substrate to be coated with a homogeneous and continuous coating layer, or that the coating layer is only partially applied, on chosen parts of the surface on one side of the substrate. In the latter case, a coating layer may be formed to have a chosen pattern and/or e.g. only on the parts of the substrate surface that are to be sealed against each other (in case the coating layer is a sealing layer). Besides being a sealing layer, it may for example be conceived, but not limited to, that the coating layer is an aroma barrier layer, a gas barrier layer, a gloss contributing layer, a layer for improved gripping, a scavenging layer, a delamination layer, an adhesive layer, or a liquid barrier layer, and that the polymer is one or more polymers suitable therefore according to what is well known to the person skilled within the field.

BRIEF DESCRIPTION OF THE ACCOMPANYING DRAWINGS

In the following, the present invention will be described in greater detail with reference to a preferred embodiment and with reference to the enclosed FIG. 1 that schematically and by principle shows a device according to the invention.

DETAILED DESCRIPTION OF THE INVENTION

Detail no. 1 in FIG. 1 generally denotes mixing equipment for mixing a pulverous, polymeric material 2 with a fluid 3, in the shown case a liquid or more specifically water. Other conceivable liquids may be of the type that they affect the surface properties of the polymer particles, such as their surface tension. The polymeric material may be any type of polymeric material that is suitable to form a coating layer on a substrate, especially a packaging laminate for liquid foods, and that is insoluble in the chosen fluid. A preferred polymeric material is a polyolefin, such as a polyethylene of any suitable grade.

A suspension of polymer particles in liquid is formed in mixing equipment 1. The mixing equipment may also comprise a heating system 4 for heating the suspension, such as to 50-99° C. if the polymer is a polyolefin. The drawing symbolically shows an agitator, but any other mixing equipment is conceivable, such as a mixing equipment comprising a revolving drum.

From the mixing equipment 1, the suspension is led to pressurising equipment 5, such as a pump, in which the suspension is pressurised up to a pressure of 100 bar. Also in connection with the pressurisation, the suspension can be additionally heated, preferably by indirect heat transfer 6. As long as the polymer particles are in the liquid suspension, i.e. at least until they leave the nozzle 9 (see below), the temperature on the surface of the polymer particles should however not be brought to exceed the melting temperature of the polymer.

The increase in fluid temperature, where appropriate the water temperature, can be achieved by for example microwave equipment. By microwaves, the energy content of the water, i.e. its temperature, may be much more increased than that of the polymer granulate.

Now, the suspension is supplied to flow controlling equipment 7. The flow controlling equipment 7 is also provided with an outlet/a nozzle 9, through which the suspension is ejected/sprayed under pressure. In the shown case, the flow controlling equipment 7 is provided with a flow controlling needle 8 that can be vertically displaced in the outlet, but other means for flow controlling are also conceivable, e.g. comprising vibrators.

If the entire surface of the substrate is to be coated, the open cross-section of the nozzle 9 is elongated over the width of the substrate 10. Optionally, several elongated nozzles can be arranged consecutively (not shown), so that layer upon layer of the coating is formed on the substrate. If only parts of the substrate are to be coated, the nozzle will instead be of circular shape or possibly elongated but only extending over a part of the width of the substrate 10.

After the nozzle, there is a heating zone 11, in which heating equipment 12 heats the suspension jet ejected from the nozzle 9, normally to a temperature above the softening temperature for the polymer but below its melting temperature. It should not be excluded however that the method according to the invention may work also if the suspension or polymer is heated to a temperature above the melting temperature of the polymer, in any of the heating steps. At the heating, the liquid is evaporated from the suspension jet 16, and the polymer particles are softened, at least on their surface. Therefore, the polymer particle jet is essentially free from liquid as it hits the substrate 10. An exhaust 14 is arranged to remove evaporated liquid fumes. As the polymer particles thereafter hit the substrate 10 by great force, thanks to the pressurisation of the system, a sintering-like coating 13 will be formed on the substrate, whereby the individual polymer particles are united to each other. Optionally, additional heating treatment or some other post treatment may follow (not shown), in order for the coating to acquire the desired properties.

The heating in the heating zone 11 is preferably direct but contactless, and makes use of controllable high power heating equipment 12, such as irradiation, laser, microwaves or similar; or some other high power technique/equipment.

Upstream and in direct connection with the coating position, the substrate 10 may optionally be pretreated, preferably for increased adhesion by activation of its surface (increasing the surface energy), by e.g. flame treatment, symbolised by arrow 15. Preferably, the substrate is a substrate for a packaging laminate, preferably comprising one or more layers in the group that consists of a fibre based core layer, a polymer core layer, a gas barrier layer (such as of aluminium or a polymeric material), an adhesive layer, a liquid barrier layer and a sealing layer.

Optionally, the surface of the polymeric pulverous particles may be affected/pretreated, e.g. to counteract agglomeration of the pulverous particles in the suspension, preferably by treating the pulverous particles or by addition to the suspension of an agent that affects the surface, such as a tenside.

The invention is not restricted to the shown embodiment but can be varied within the scope of the claims. It may for example be conceived that the liquid is initially heated and/or pressurised, before the pulverous polymer is suspended therein. If the liquid is pressurised before the heating is completed in the initial heating step(s), it is of course possible to heat to a temperature above the boiling point of the liquid, if so is desired depending on choice of polymer. If the fluid is gaseous, such as air or an inert gas, the evaporation step is of course excluded, but the heating remains with the purpose of achieving a softening of the surface of the polymer particles. The ratio of polymer/fluid may initially be 10/90 to 50/50 (%), independent of the type of fluid.

The invention claimed is:

1. A method of providing a substrate comprising a fiber based layer with a coating layer of a polymeric material, comprising:

a) suspending a pulverous, polymeric material in a fluid, the polymeric material possessing a softening temperature and a melting temperature, b) pressurizing the fluid to produce a pressurized suspension, c) ejecting the pressurized suspension onto the substrate comprising the fiber based layer to form the coating layer, d) heating the polymeric material, during any one of the steps a)-c), to a temperature above the softening temperature of the polymeric material and below the melting temperature of the polymeric material, wherein the pulverous, polymeric material is suspended in the fluid before pressurizing the fluid and before ejecting the pressurized suspension.

2. A method according to claim 1, wherein said heating in step d) is performed during step c).

3. A method according to claim 1, wherein said fluid is a gaseous fluid.

4. A method according to claim 1, wherein said fluid is a liquid which is evaporated in connection with the heating in step d) during step c), so that the polymeric material is essentially free from the fluid as the polymeric material hits the substrate.

5. A method according to claim 1, wherein the suspension is heated before step d).

6. A method according to claim 1, wherein the pulverous polymeric material in step a) has a mean particle size of 1-100 μm, the pulverous particles being constituted of pulverous particles formed directly in manufacturing of the polymeric material.

7. A method according to claim 1, wherein the surface of the polymeric pulverous particles is affected to counteract agglomeration of the pulverous particles in the suspension.

8. A method according to claim 1, wherein the substrate is a substrate for a packaging laminate.

9. A method according to claim 1, wherein the substrate is pretreated in direct connection with step c), for increased adhesion of the polymeric material.

10. A method according to claim 1, wherein said coating layer is applied at a thickness of 0.1-5 μm.

11. A method according to claim 1, wherein said coating layer is applied on essentially the entire surface of one side of the substrate.

12. A method according to claim 1, wherein said coating layer is applied only partially, on chosen parts of the surface of one side of the substrate.

13. A method according to claim 1, wherein said fluid is one of air and an inert gas.

14. A method according to claim 1, wherein the suspension is heated in one of step a) and step b).

15. A method according to claim 1, wherein the pulverous polymeric material in step a) has a mean particle size of 1-50

μm and is constituted of pulverous particles formed directly in manufacturing of the polymeric material.

16. A method according to claim 1, wherein the pulverous polymeric material in step a) has a mean particle size of 1-25 μm and is constituted of pulverous particles formed directly in manufacturing of the polymeric material.

17. A method according to claim 1, further comprising adding an agent to the suspension or treating the pulverous particles to affect the surface of the polymeric pulverous particles in a manner that counteracts agglomeration of the pulverous particles in the suspension.

18. A method according to claim 1, wherein said coating layer is applied at a thickness of 0.1-2 μm.

19. A method according to claim 1, wherein said coating layer is applied at a thickness of 0.1-1 μm.

20. A method according to claim 1, wherein the coating layer of polymeric material is homogeneous and continuous.

21. A method according to claim 1, wherein the fluid is pressurized to a pressure of about 100 bar.

22. A method of providing a substrate comprising a fiber based layer with a coating layer of a polymeric material, comprising:

a) suspending a pulverous, polymeric material in a fluid, the polymeric material possessing a softening temperature and a melting temperature, b) pressurizing the fluid to produce a pressurized suspension, c) ejecting the pressurized suspension onto the substrate comprising the fiber based layer to form the coating layer, d) heating the polymeric material, during any one of the steps a)-c), to a temperature above the softening temperature of the polymeric material and below the melting temperature of the polymeric material.

23. A device for providing a substrate with a coating layer of a polymeric material, comprising:

mixing equipment, arranged to suspend a pulverous polymeric material in a fluid, pressurizing equipment, arranged to pressurize said fluid, at least one nozzle operatively connected to the pressurizing equipment and arranged to eject the suspension of polymeric material in fluid towards the substrate, first heating equipment arranged to heat the polymeric material upstream of the at least one nozzle;

second heating equipment arranged downstream of the at least one nozzle to heat the suspension of polymeric material ejected from the at least one nozzle before reaching the substrate to a temperature above the softening temperature of the polymeric material and below the melting temperature of the polymeric material, wherein the mixing equipment is arranged to suspend the pulverous polymeric material in the fluid before the pressurizing equipment pressurizes the fluid and before the at least one nozzle ejects the pressurized suspension.

24. A device according to claim 23, comprising flow controlling equipment arranged to control a flow of the suspension in said nozzle.

25. A device according to claim 23, comprising means arranged to pretreat the substrate, preferably comprising activation of the surface of the substrate.

26. A device according to claim 23, comprising means arranged to pretreat the substrate by activation of the surface of the substrate.

* * * * *